US005905472A

United States Patent [19]

Wolfson et al.

[11] Patent Number: 5,905,472

[45] Date of Patent: May 18, 1999

[54] MICROWAVE ANTENNA HAVING WIDE ANGLE SCANNING CAPABILITY

[75] Inventors: Ronald I. Wolfson, Los Angeles; William W. Milroy, Playa del Rey; Alan C. Lemons, Hermosa Beach; Stuart B. Coppedge, Manhattan Beach, all of Calif.

[73] Assignee: Raytheon Company, Lexington, Mass.

[21] Appl. No.: 08/906,699

[22] Filed: Aug. 6, 1997

[51] Int. Cl.[6] ..... H01Q 13/00

[52] U.S. Cl. ..... 343/772; 343/762; 343/776; 342/81

[58] Field of Search ..... 343/5, 785, 772, 343/762, 770, 771, 776, 777; 333/7 D; 342/81; H01Q 13/00

[56] References Cited

U.S. PATENT DOCUMENTS

| | | | |
|---|---|---|---|
| 2,943,325 | 6/1960 | Rotman | 343/762 |
| 3,205,493 | 9/1965 | Cohen | 343/5 |
| 3,768,041 | 10/1973 | Carlise | 333/7 D |
| 4,691,208 | 9/1987 | Stern et al. | 343/785 |
| 4,868,574 | 9/1989 | Roab | 342/81 |
| 5,266,961 | 11/1993 | Milroy | 343/772 |

*Primary Examiner*—Hoanganh Le
*Assistant Examiner*—Shih-Chao Chen
*Attorney, Agent, or Firm*—Leonard A. Alkov; Glenn H. Lenzen, Jr.

[57] ABSTRACT

A planar array antenna having a switching matrix that couples an RF signal to two distributed ferrite scanning line feeds that feed a planar continuous transverse stub array antenna. The scanning line feeds couple RF energy to the antenna from opposite sides to form a total of four beams offset in space that each cover different angular scan sectors. The antenna has reduced complexity and lower design and production costs. The use of dual ferrite scanning line feeds, the switching matrix, and the continuous transverse stub antenna to obtain wide-angle scanning provides significantly improved performance. The present invention uses the two distributed ferrite scanning line feeds to obtain greater scan coverage at upper millimeter-wave frequencies, where realizable ferrite materials are less active and provide diminished scan capability. The scanning line feeds and planar array antenna may be designed so that the four scan sectors are contiguous, to increase the angular scan coverage of the antenna. The switching matrix is used to sequentially feed each of four RF ports, which effectively produces a single beam that scans over the four contiguous scan sectors.

9 Claims, 3 Drawing Sheets

Fig. 4
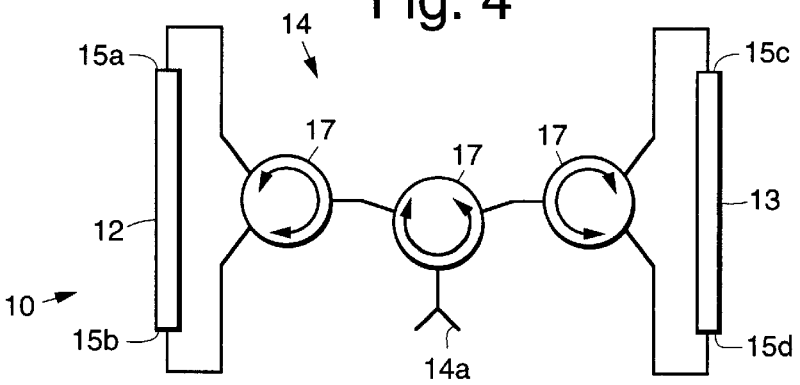
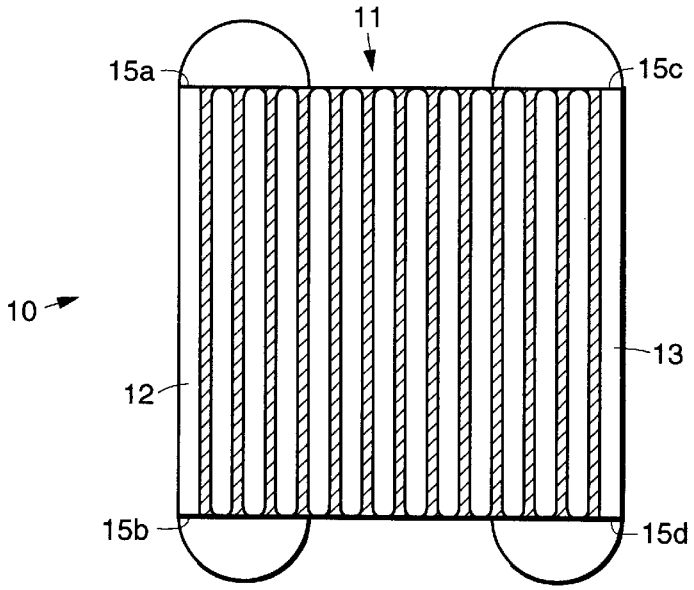
Fig. 5
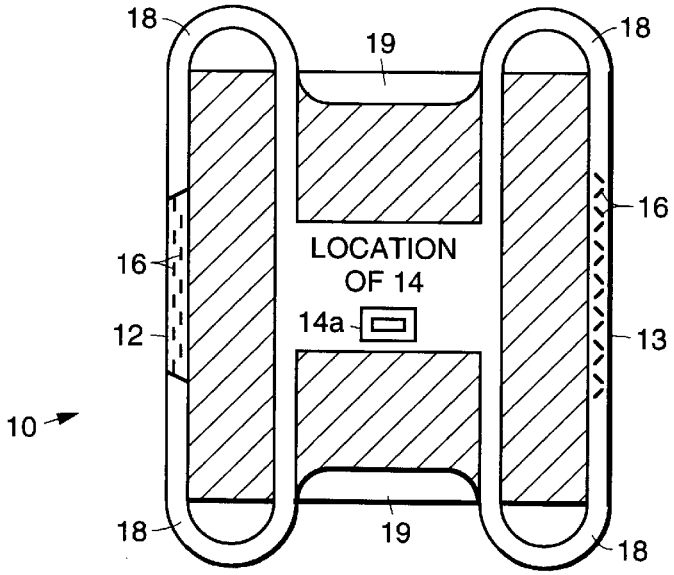
Fig. 6

MICROWAVE ANTENNA HAVING WIDE ANGLE SCANNING CAPABILITY

BACKGROUND

The present invention relates generally to microwave antennas, and more particularly, to a microwave antenna having wide angle scanning capability.

Prior art teaches how a scanning line feed can be fed from its opposite ends to form two beams that are offset in space. Such scanning line feeds are described in articles by Nester, et al. entitled "Bidirectional Series Fed Slot Array", Symp. Digest, IEEE Antennas and Propagation Society International Symposium (Stanford, Calif.), June 1977, pg. 76, or Kinsey entitled "FAST Multibeam Antenna Concept", RADC-TR-85-170, Proc. Phased Arrays 1985 Symposium (Hanscom AFB, Mass.), September 1985, pp. 33–56.

There is increasing interest in low-cost, one-dimensional electronically scanned antennas for military and commercial applications, such as W-band targeting radars and forward looking radar automotive systems at 77 GHz, for example. Low-cost two-dimensional scanning can be realized by using the aforementioned one-dimensional electronic scan antenna in conjunction with a 360° gimbal in the second axis. Conventional scanning techniques, such as PIN diodes, discrete ferrite phase shifters or transmit/receive (T/R) modules are generally either not available, not producible, or are relatively unaffordable at W-band.

Ferrite phase scanning antennas that radiate into free space are described in the technical literature. Ferrite phase scanning antennas are discussed in articles by Stern, et al. entitled "A mm-Wave Homogeneous Ferrite Phase Scan Antenna," Microwave Journal, Vol. 30, No. 4, April 1987, pp. 101–108, and U.S. Pat. No. 4,691,208 entitled "Ferrite Waveguide Scanning Antenna", for example.

A ferrite scanning line feed is a device that is similar to the previously discussed scanning line feed, and has the same limitations in scan range. The distinction is that the line feed is specifically designed to radiate into a parallel-plate region of a planar array antenna, which may be either air or dielectrically filled. Further, the scanning line feed is designed using bidirectional array excitation synthesis to be fed from either end, producing two well-formed beams offset in space.

A major disadvantage of the prior art is the limited scan coverage that can be realized with ferrite phase scanned antennas at high millimeter-wave frequencies, typically on the order of from 40 GHz and above. It would therefore be an advance in the art to have a planar array antenna that does not require a multitude of line feeds that are scanned with discrete phase shifters, such as those described in the Kinsey article, for example. It would also be an advantage to have a planar array antenna that has reduced complexity with much lower design and production costs. Accordingly, it is an objective of the present invention to provide for a microwave antenna having wide angle scanning capability.

SUMMARY OF THE INVENTION

The present invention provides for a planar array antenna that uses two distributed ferrite scanning line feeds to feed a planar array antenna, such as a continuous transverse stub array. The scanning line feeds couple RF energy to the antenna from opposite sides to form a total of four beams offset in space that each cover different angular scan sectors. The present invention does not require a multitude of line feeds that are scanned with discrete phase shifters such as is described in the Kinsey article. This reduction in complexity, combined with a 360° gimbal in the second axis, results in lower design and production costs for the antenna. The use of dual ferrite scanning line feeds, a switching matrix, and a planar array antenna to obtain wide-angle scanning significantly improves the performance of continuous transverse stub (CTS) antennas and systems.

The present invention uses the two distributed ferrite scanning line feeds to obtain greater scan coverage at upper millimeter-wave frequencies, where realizable ferrite materials are less active and provide diminished scan capability. The scanning line feeds and planar array antenna may be designed so that the four scan sectors are contiguous, thereby increasing the angular scan coverage of the antenna at least fourfold. The switching matrix is used to sequentially feed each of four RF ports to effectively produce a single beam that scans over the four contiguous scan sectors.

BRIEF DESCRIPTION OF THE DRAWINGS

The various features and advantages of the present invention may be more readily understood with reference to the following detailed description taken in conjunction with the accompanying drawings, wherein like reference numerals represent like structural elements, and in which:

FIG. 4 illustrates a switching matrix having three switching ferrite circulators;

FIGS. 5 and 6 illustrate how scanning line feeds couple through a ground plane into the parallel-plate region of a continuous transverse stub array antenna;

DETAILED DESCRIPTION

Figure 1:
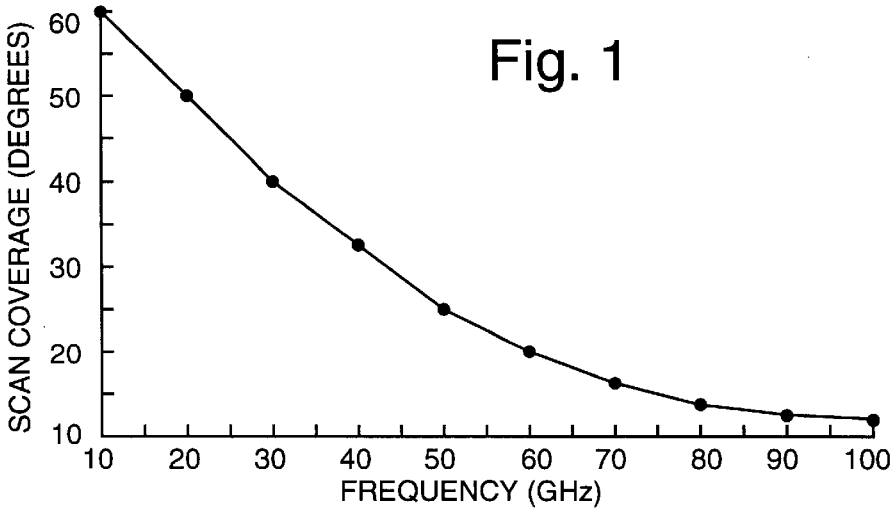
FIG. 1 illustrates the computed scan coverage versus frequency for a ferrite line scanner with 4 $\pi M_s$=5,000 Gauss.

Referring to the drawing figures, FIG. 1 shows a graph illustrating the computed scan coverage versus frequency that is achievable for a typical conventional ferrite line scanner using state-of-the-art ferrite materials with the maximum saturation magnetization (4 $\pi M_s$) available, which is approximately 5,000 Gauss. The graph of FIG. 1 is based on measured data of differential phase shift per inch at several millimeter-wave frequencies. Approximately 625°/inch was obtained at 94 GHz. This produces only about 12.6 degrees of scan coverage, while as much as 60 degrees may be required for certain antenna applications.

Figure 2:
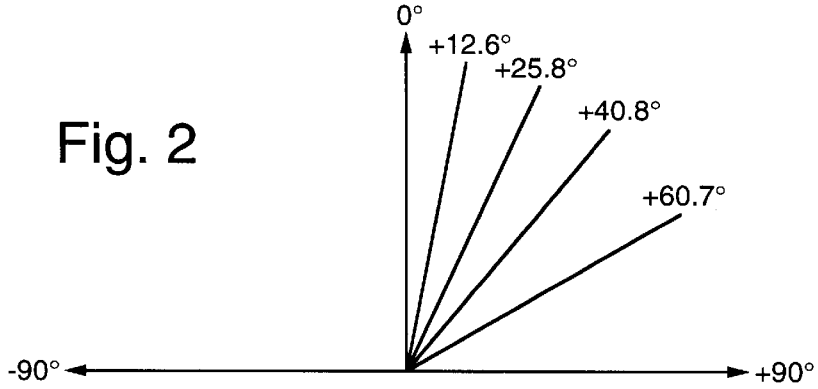
FIG. 2 illustrates how contiguous scan sectors covering over 60° are produced by switching between four RF ports.

FIG. 2 shows four contiguous scan sectors that are produced by the present invention that cover 0° to +12.60°, +12.6° to +25.8°, +25.8° to +40.8°, and +40.8° to +60.7°, respectively. These numbers are derived from the expression:

$$\theta_{n\ max}=\mathrm{Sin}^{-1}\ (n\lambda\Delta\phi/360),$$

where: $\theta_{n\ max}$ is the maximum scan angle for a given scan sector, n is the scan sector (1 through 4 for this example), $\lambda$ is the wavelength in air in inches (0.1256 inches for 94 GHz); and $\Delta\phi$ is the differential phase shift in degrees per inch (625).

The present invention switches between multiple contiguous scan sectors as shown in FIG. 2 in order to increase the total angular scan coverage of a scanning antenna 10 (shown in FIGS. 3*a* and 3*b*), and is believed to be unique as applied to a planar array scanning antenna 10, such as a continuous transverse stub antenna 11 developed by the assignee of the present invention. The continuous transverse stub antenna 11 is described in U.S. Pat. No. 5,266,961 assigned to the assignee of the present invention and the disclosure thereof is incorporated herein by reference in its entirety. The principles of the present invention may also be used where noncontiguous, widely separated or multiple simultaneously scanned sectors are desired.

Figure 3A:
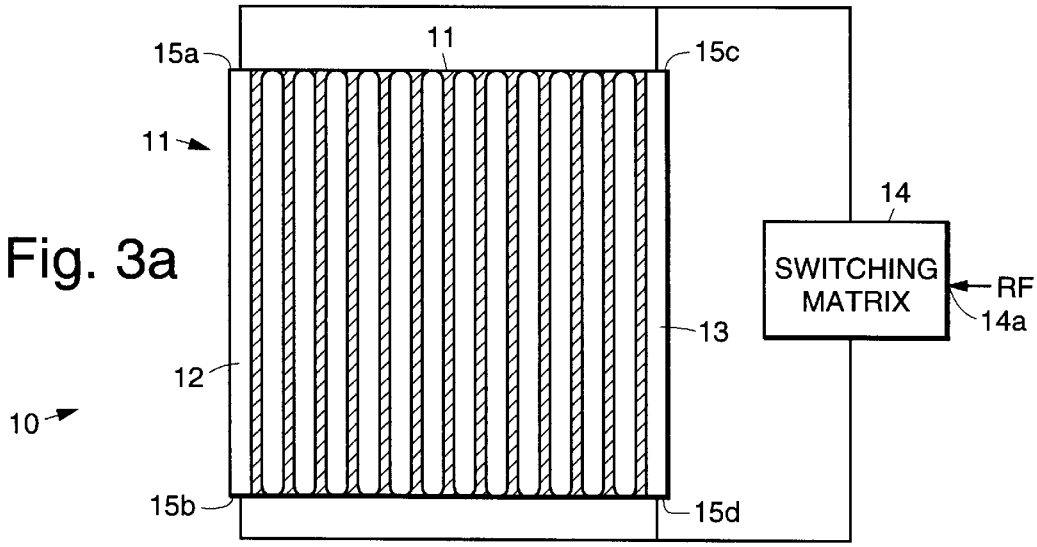
FIGS. 3*a* and 3*b* illustrate a planar array antenna in accordance with the present invention edge-fed by two scanning line feeds.
Figure 3B:
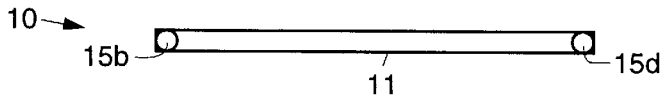

FIGS. 3*a* and 3*b* show top and side views, respectively, of a planar array antenna 10 in accordance with the present invention. The planar array antenna 10 comprises a continuous transverse stub array antenna 11 that is fed edgewise by two scanning line feeds 12, 13 (ferrite line scanners) disposed along opposite sides of the continuous transverse stub array antenna 11. A switching matrix 14 is used to feed an RF signal from an RF port 14*a* to respective ports 15*a*–15*d* of the scanning line feeds 12, 13. RF energy couples through slots 16 (FIG. 6) in a common wall between parallel-plate regions of the scanning line feeds 12, 13 and the continuous transverse stub array antenna 11. The continuous transverse stub array antenna 11 is designed in a manner similar to the line feeds 12, 13 using bidirectional array excitation synthesis to produce a well-formed beam when it is fed along either side. The switching matrix 14 sequentially feeds each of the four RF ports 15*a*–15*d*. The scanning line feeds 12, 13 feed the planar array antenna 11 from opposite sides to form a total of four beams offset in space that each cover different angular scan sectors. This effectively produces a single beam that scans over four contiguous scan sectors.

A four-way switching matrix 14 directs an RF signal to a selected antenna port 15*a*–15*d*. FIG. 4 shows how a single pole, four throw (SP4T) switching matrix 14 may be configured using three switching ferrite circulators 17. Typical W-band performance for a single, narrow-band junction circulator 17 provides for a 0.4 to 0.6 dB insertion loss and 18 to 20 dB isolation. Greater isolation may be obtained by placing additional junction circulators 17 in switch arms of the switching matrix 14 shown in FIG. 4, but this increases the insertion loss accordingly.

Figure 7:
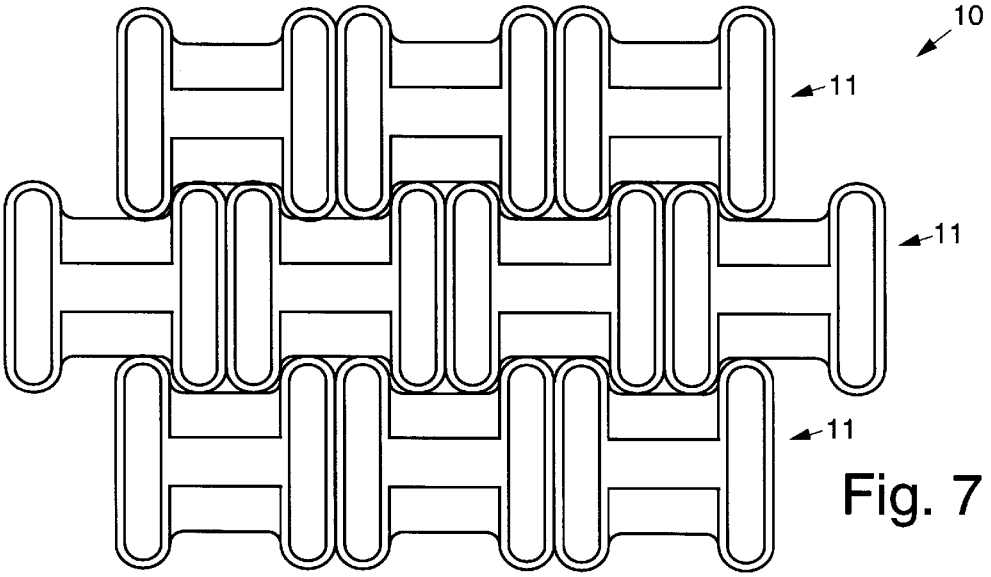
FIG. 7 illustrates a planar array antenna comprised of continuous transverse stub subarrays nested in a triangular lattice.

FIGS. 5 and 6 show a suitable arrangement that may be used to package a plurality of continuous transverse stub antennas 11 (subarrays 11) in a very tight lattice. Because the apertures of the continuous transverse stub antennas 11 are so close to one another, the line feeds 12, 13 cannot be physically located along the edges of the antenna 11 as shown in FIG. 3, and are placed behind the aperture or the antenna 11. Coupling between the line feeds 12, 13 and the antenna 11 is implemented using coupling slots 16 disposed through a common ground plane wall. Two types of coupling slots 16 are illustrated in FIG. 6, which include longitudinal shunts slots 16 alternately offset from the broadwall centerline in the first feed 12, and inclined slots 16 in the second feed 13. 180-degree waveguide bends 18 that connect the feed ports 15*a*–15*d* to the switching matrix 14 extend beyond the outline of the aperture of the continuous transverse stub antenna 11 along a vertical direction. However, pockets 19 on the back side of the antenna 11 (shown in FIG. 6) allow the antennas 11 (subarrays 11) to be nested, as is shown in FIG. 7 to produce a complete planar array antenna 10.

Figure 8A:
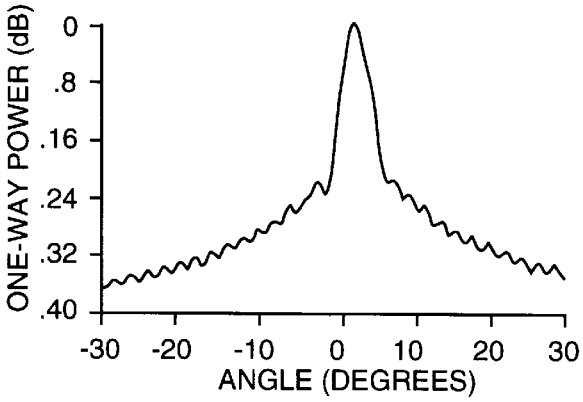
FIGS. 8*a* and 8*b* show computed forward-fired and backward-fired beam patterns, respectively, of a 77 GHz line feed designed using a modified Woodward-Lawson synthesis.
Figure 8B:
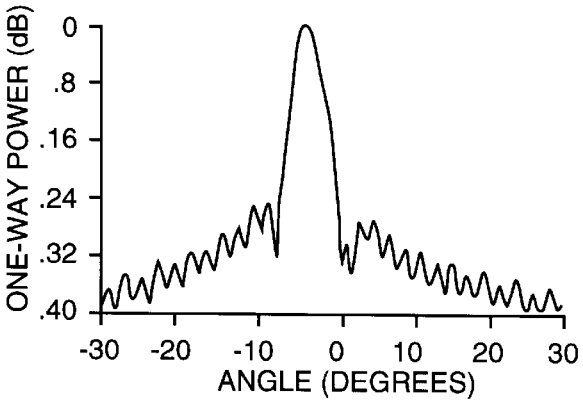

FIGS. 8*a* and 8*b* show computed forward-fired and backward-fired beam patterns, respectively, for a 77 GHz bidirectional line feed 12, 13 that is 4.49 inches long. A modified Woodson-Lawson synthesis was used to create the line feed 12, 13, with exponential functions replacing conventional uniform functions. The beam patterns, although not optimized, meet nominal array requirements of a 2.2 degrees beamwidth at the −3 dB points and sidelobes below 20 dB. The forward-fired beam pattern has a taper loss of 1.06 dB, VSWR of 1.06:1 and 3.6 percent power into the load. The back-fired beam pattern has a taper loss of 1.10 dB, VSWR of 1.04:1 and 2.9 percent power into a load. As stated previously, a similar bidirectional array excitation synthesis may be used to design the continuous transverse stub array antenna 11.

The present invention may be configured to provide a low-cost solution for achieving scan coverage throughout the volume of a cone. This may be done by mounting a one-dimensional scanner on a roll gimbal (i.e., a "lazy Susan"). With this arrangement, the one-dimensional scanner only needs to cover one-half of the apex angle (i.e., from the zero axis of the cone to the slant angle). As the gimbal rotates in an orthogonal plane, the scanning beam will "sweep out" a conical scan volume.

The present invention was originally developed to address a specific application where a one-dimensional scanner requires zero to 60 degree coverage. However, other options for wide angle scanning may be provided by the present invention.

For example, the present invention may be used to provide scan coverage that is symmetrical with respect to broadside (zero degrees). This is the typical scan coverage of a forward looking automotive antenna, for example. The present scanner may be modified to have four contiguous scan sectors, that scans from zero to ±12.59° and from ±12.59° to ±25.85°, which are desirable for a forward looking automotive antenna.

The present invention may be used to provide scan coverage that provides an asymmetrical scan about broadside. A shipboard antenna is often tilted upward as much as 20 degrees to accommodate coverage at higher elevation angles as the ship rolls downward. For example, an antenna tilted upward 12.5 degrees may be configured to provide four contiguous scan sectors that cover −12.59 to +40.85 degrees. If the ship is stabilized to limit roll to 10 degrees maximum, elevation coverage of at least +30 degrees may be realized.

The four scan sectors provided by the present invention need not be contiguous, but may overlap or be angularly separated. If two scan sectors overlap with beams offset in space by about one-half a beam width, then a scanning difference pattern may be formed by sequentially lobing between the two adjacent beams. An example where separate scan sectors are desirable is a side-looking radar mounted on the underside of an aircraft. Scan coverage might be ±12.59 degrees to ±25.85 degrees, with a gap between −12.59 and +12.59 degrees.

Furthermore, any of the four scan sectors may be simultaneous scanned, rather than sequentially scanned. However, this requires a different switching matrix than the SP4T switching matrix 14 shown in FIG. 4. In a simultaneous beam scanning application, the switching matrix 14 is designed to simultaneously switch on one through four beams at any given time. Such a simultaneous switching matrix 14 is conventional and well-known, and may be readily designed by those skilled in the art and will not be described herein. With simultaneous overlapping beams, the scanning difference pattern described above would not require lobing.

Thus, an improved planar array microwave antenna having wide angle scanning capability has been disclosed. It is to be understood that the described embodiment is merely illustrative of some of the many specific embodiments which represent applications of the principles of the present invention. Clearly, numerous and other arrangements can be readily devised by those skilled in the art without departing from the scope of the invention.

What is claimed is:

1. A planar array microwave antenna comprising:

a continuous transverse stub array antenna;

first and second scanning line feeds disposed along opposite edges of the continuous transverse stub array antenna that comprise first and second RF ports, respectively, that feed an RF input signal to the continuous transverse stub array antenna; and a switching matrix coupled between an RF input port of the antenna and respective ports of the scanning line feeds;

and wherein the scanning line feeds couple RF energy to the planar array antenna from opposite sides to form a total of four beams offset in space that each cover different angular scan sectors.

2. The antenna of claim 1 wherein four beams effectively produce a single beam that scans over four contiguous scan sectors.

3. The antenna of claim 1 wherein RF energy is coupled through slots in a common wall between parallel-plate regions of the scanning line feeds and the continuous transverse stub array antenna.

4. The antenna of claim 1 wherein the switching matrix comprises a four-way switching matrix.

5. The antenna of claim 1 wherein the four-way switching matrix comprises three switching ferrite circulators.

6. The antenna of claim 1 wherein scan coverage is symmetrical with respect to broadside.

7. The antenna of claim 1 wherein scan coverage is asymmetrical with respect to broadside.

8. The antenna of claim 1 wherein the four beams scam over four scan sectors that overlap.

9. The antenna of claim 1 wherein the four beams scam over four scan sectors that are angularly separated from each other.

* * * * *